US006454142B1

(12) United States Patent
Meynet

(10) Patent No.: US 6,454,142 B1
(45) Date of Patent: Sep. 24, 2002

(54) PRESSURIZED BEVERAGE DISPENSER

(76) Inventor: Armando Meynet, 15702 Woodcock Pl., Tampa, FL (US) 33624

( * ) Notice: Subject to any disclaimer, the term of this patent is extended or adjusted under 35 U.S.C. 154(b) by 0 days.

(21) Appl. No.: 09/897,313

(22) Filed: Jul. 2, 2001

(51) Int. Cl.[7] ..... B67D 3/00
(52) U.S. Cl. ..... 222/473; 222/509; 222/518
(58) Field of Search ..... 222/507, 509, 222/518, 472, 473, 474

(56) References Cited

U.S. PATENT DOCUMENTS

| | | | | |
|---|---|---|---|---|
| 565,922 A | | 8/1896 | Prax | |
| 1,648,575 A | | 11/1927 | Campbell | |
| 2,049,851 A | | 8/1936 | Madan | |
| 2,189,643 A | | 2/1940 | Ward | |
| 2,199,655 A | | 5/1940 | Sollinger | |
| 2,345,081 A | * | 3/1944 | Ward | 222/509 |
| 2,547,109 A | | 4/1951 | Bacheller | |
| 2,574,534 A | * | 11/1951 | Curto | 222/509 |
| 2,751,130 A | * | 6/1956 | Murphy | 222/509 |
| 2,837,247 A | | 6/1958 | Stewart | |
| 2,915,251 A | | 12/1959 | North | |
| 2,928,576 A | * | 3/1960 | Kochner | 222/509 |
| 3,154,224 A | | 10/1964 | Wakeman | |
| 3,221,953 A | | 12/1965 | Shurtleff | |
| 3,458,090 A | | 7/1969 | Scoggin | |
| 3,459,345 A | * | 8/1969 | Chernak et al. | 222/518 |
| 3,734,125 A | * | 5/1973 | Bruce et al. | 222/509 |
| 4,120,431 A | * | 10/1978 | Schultz | 222/518 |
| 4,194,653 A | | 3/1980 | Brown | |
| 4,720,076 A | * | 1/1988 | Hyde | 222/509 |
| 4,844,301 A | * | 7/1989 | Juillet | 222/509 |
| 5,292,038 A | | 3/1994 | Seney | |

FOREIGN PATENT DOCUMENTS

GB 2177185 A * 1/1987 ..... B67D/03/00

OTHER PUBLICATIONS

Jokari/US, INC.—"Soda Dispenser" Copyright 1996; Texas, USA; www.jokari.com—Item 05001.

* cited by examiner

*Primary Examiner*—Kenneth Bomberg

(57) ABSTRACT

The disclosed invention is directed to a sealing and dispensing apparatus that is used to preserve the contents of a carbonated beverage container. It includes a novel double plug seal located in a plug fluid chamber having a wider portion and a narrow portion. The double seal plug engages at its forward end with the discharge port. The aft end of the double seal plug engages the narrow portion of the plug fluid chamber. Taken together, the double seals allow for reduced spraying and leakage of fluid from the apparatus, both during and after fluid is dispensed. The invention also relates to a novel method for attaching the plug to the actuator. It also relates to an improved design for attaching an apparatus to a beverage container, and a novel design for gradually reducing the pressure of the fluid to be dispensed, thus preserving the carbon dioxide or other gases within the fluid.

15 Claims, 6 Drawing Sheets

FIG. 2
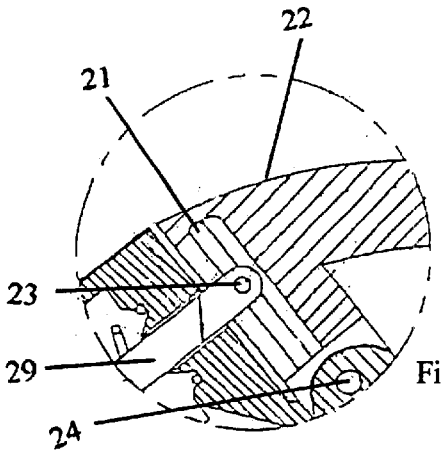
Fig. 2a
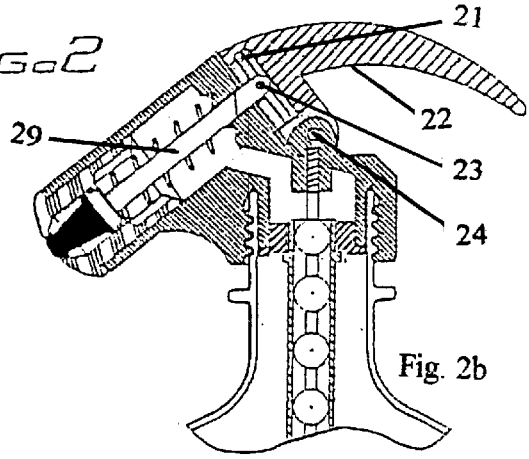
Fig. 2b
FIG. 3
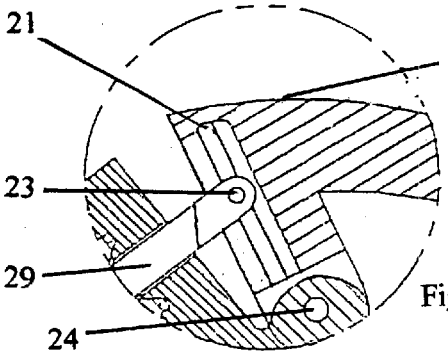
Fig. 3a
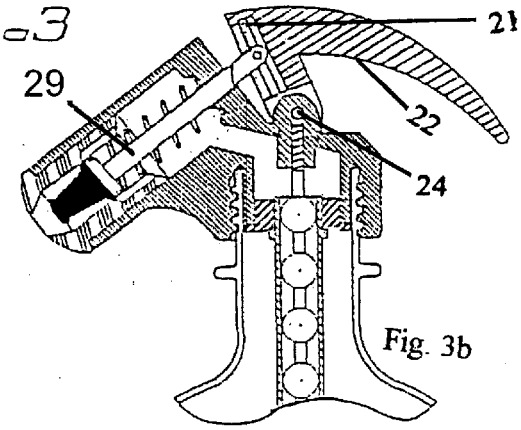
Fig. 3b
FIG. 4
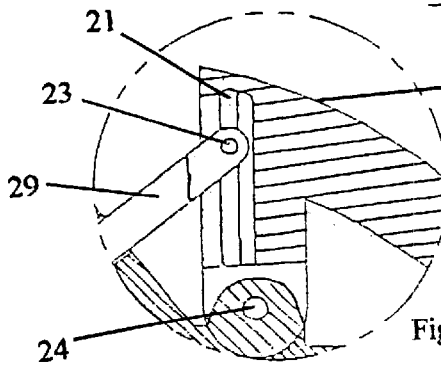
Fig. 4a
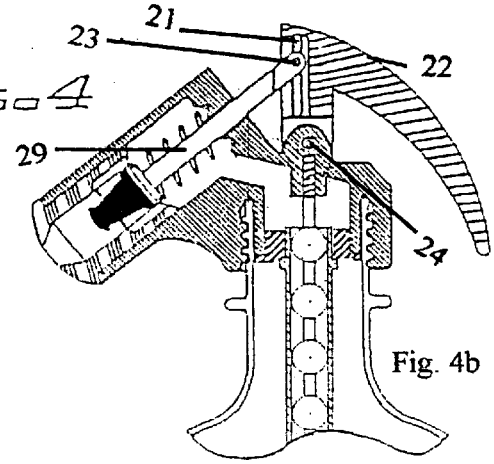
Fig. 4b

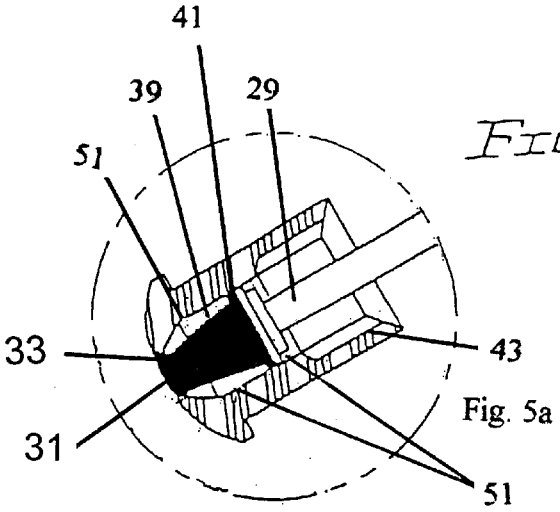
Fig. 5a
FIG. 5
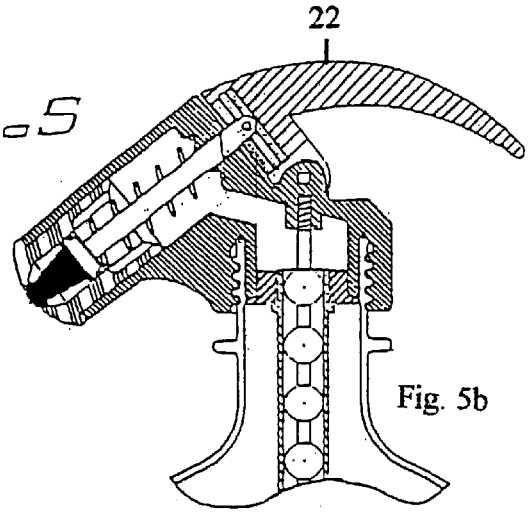
Fig. 5b
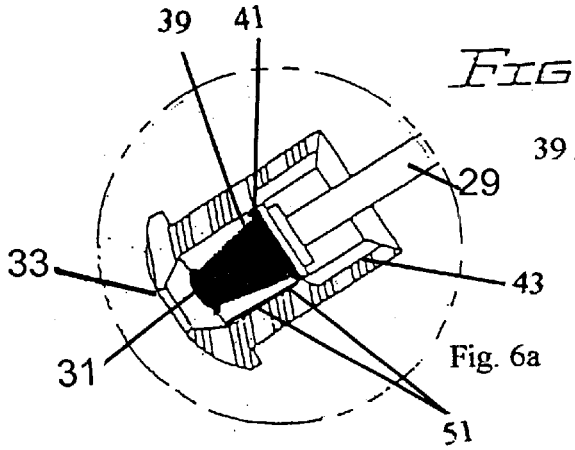
Fig. 6a
FIG. 6
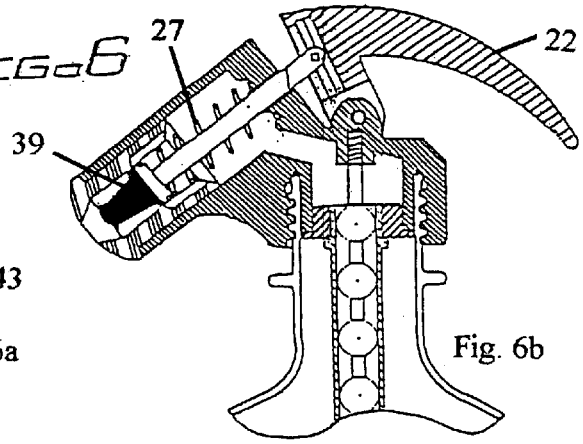
Fig. 6b
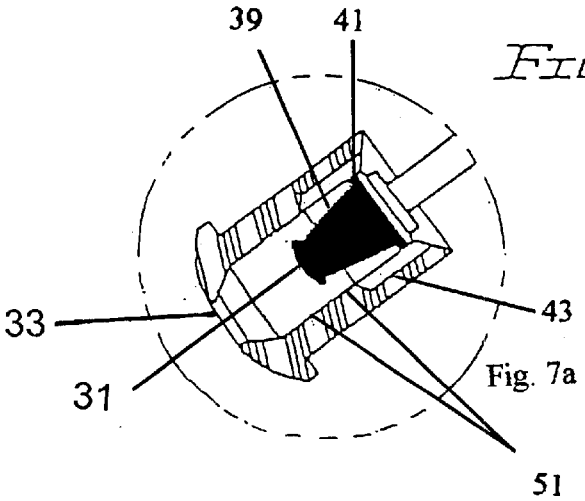
Fig. 7a
FIG. 7
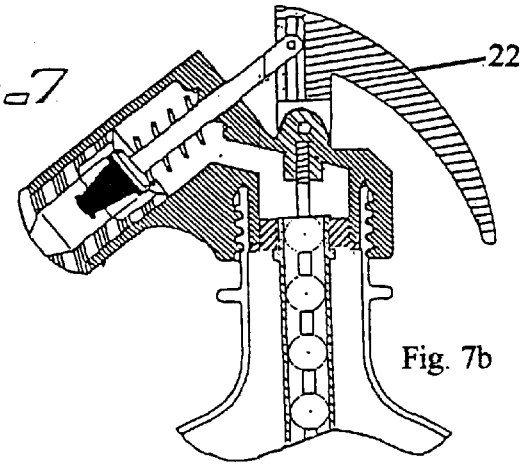
Fig. 7b FIG. 9
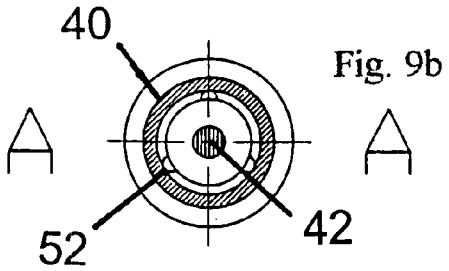
Fig. 9b
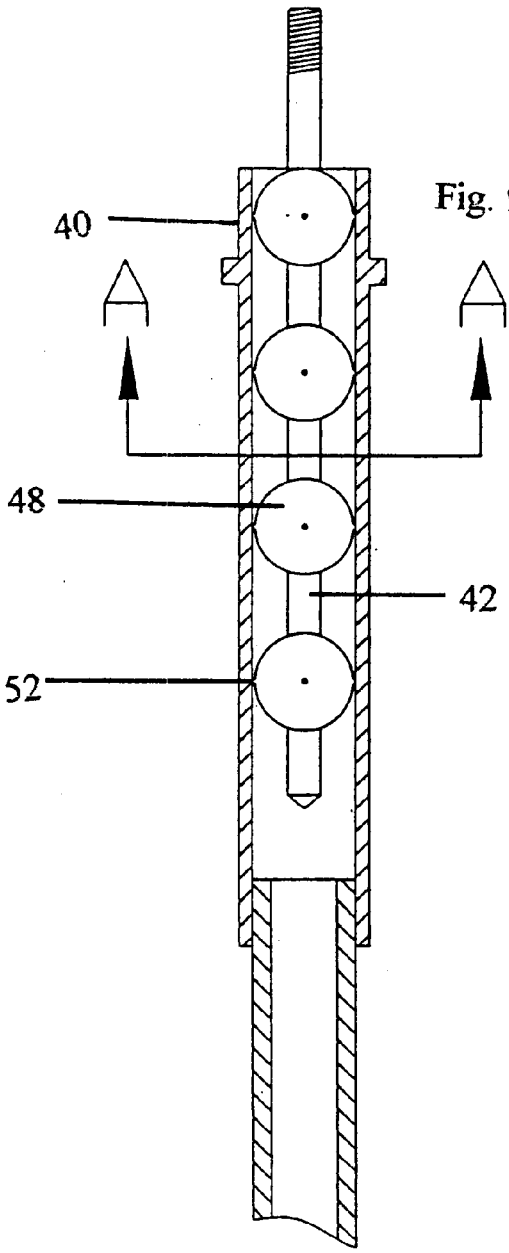
Fig. 9a FIG. 10
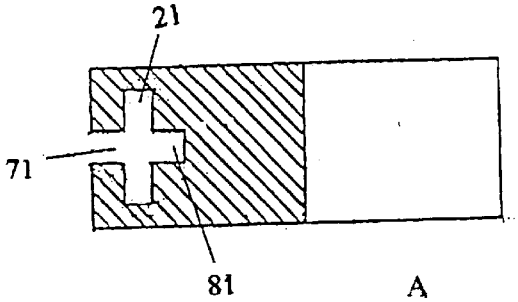
Fig. 10c
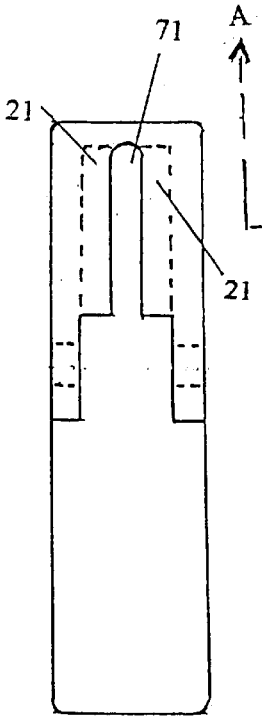
Fig. 10a
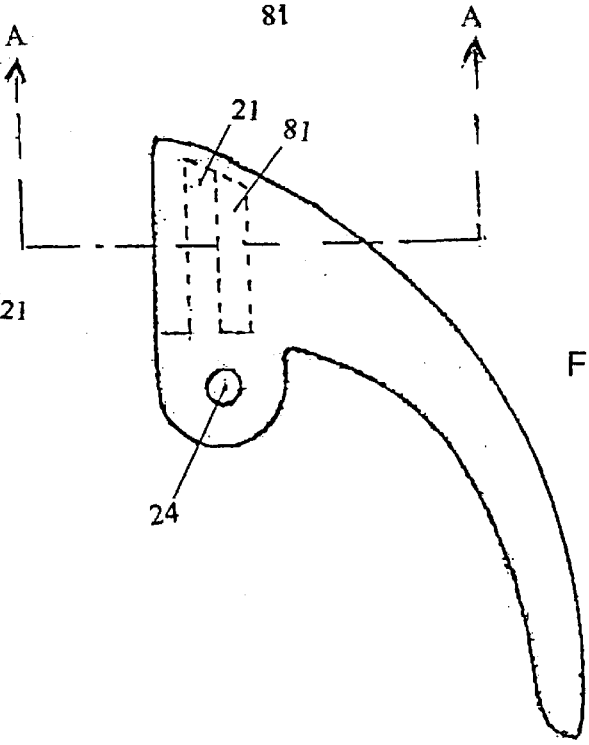
Fig. 10b

PRESSURIZED BEVERAGE DISPENSER

FIELD OF THE INVENTION

This invention relates to an apparatus for dispensing a pressurized fluid from a container. More specifically, it relates to an apparatus for dispensing carbonated beverages, where the apparatus includes a plug utilizing a double sealing configuration, a siphon tube containing flow obstructing devices that reduce the pressure of the fluid in discrete stages as it is dispensed, a sealing mechanism that assures proper alignment between the apparatus and the container, and a connecting shaft configuration which allows the connection between the handle and the head to move in a linear direction as the handle pivots.

BACKGROUND OF THE INVENTION

A universal problem in dispensing carbonated fluids from commercial containers, large containers in particular, is that the sealing cap must be removed from the container each time the fluid is dispensed, thereby permitting carbon dioxide to escape. Frequently, by the time the container is half empty, the remaining fluid has lost enough carbonization to render it "flat." When this occurs, the fluid becomes undesirable to consume and is discarded along with the container. This essentially nullifies the savings of buying a large container. Further, when these containers are discarded prematurely, they contribute to waste disposal problems. It has been estimated that if all the bottled carbonated beverages were sold in 2 liter sized bottles, bottling, packaging and distribution costs could be reduced by an estimated 30% or more.

With these problems in mind, there have been many different types of fluid dispensers created, of many and varying designs. While such devices have achieved commercial acceptance, at least to some limited extent, many suffer from a number of known disadvantages. One such deficiency lies in the fact that most known fluid dispensers are structurally complex and are thus difficult and expensive to manufacture.

A further and very significant disadvantage of many known fluid dispensers lies in the fact that to dispense the fluid, a propelling force must be employed. In general, such means include a piston-type fluid actuating mechanism and/or a pressurized gas (e.g., carbon dioxide) cartridge. Specific examples of devices involving the use of piston-type fluid actuating mechanisms for dispensing the fluid are disclosed in U.S. Pat. Nos. 2,547,109; 3,458,090 and 2,837,247. Further examples of known prior art devices, including those which employ the aforementioned carbon dioxide cartridges, are disclosed in U.S. Pat. Nos. 565,922; 1,648,575; 2,049,851; 2,189,643; 2,199,655; 2,915,251; 3,154,224 and 3,221,953. Notwithstanding the fact that a large number of such designs are known, it has been found that the piston-type actuating mechanism, as well as the carbon dioxide cartridges, are very often difficult to operate and by their inherent nature involve additional expense, both in the original purchase price of the device as well as in the overall expense of their operation and maintenance.

A solution to such problems that avoids the need for external propelling force utilizes the pressurized fluid itself as the motive force for removing the fluid from the bottle. Such devices typically employ a flow control valve mechanism and a mechanism for sealing the fluid in the bottle. In the prior art, however, typical dispensers place the flow control valve mechanism in the upward flow section of the dispenser device. A stagnation problem and the increased likelihood of attracting insects occurs when fluid collects in crevices of the valve assembly. When the next discharge of fluid occurs, this residual amount of fluid, after having stagnated and collected bacteria, is discharged along with the clean fluid in the bottle into the drinking container and consumed by the unsuspecting user.

Some devices of the prior art have attempted to overcome these drawbacks by placing the spring-type valve mechanism in the downward spout of the container. U.S. Pat. No. 5,292,038 by Seney is one such device. Although superior to other devices, the Seney device does not solve the additional problem of the discharge spout retaining a few drops of the liquid after the dispensing step is complete. In Seney, the pressurized fluid flows from the bottle up through a siphon tube, through a passage and down a downward spout, past a valve assembly, further down a discharge spout and finally out a discharge port and into a glass or other receptacle. The drawback of such devices as the Seney patent is that the valve assembly is located midway down the discharge spout, as opposed to being located at the distal end of the discharge spout. This configuration results in a few drops of the liquid adhering to the discharge spout after the user has released the valve. These drops will subsequently fall onto the counter top or other surface which is supporting the bottle, causing a mess and creating unsanitary conditions.

The prior art also contains devices which have the additional disadvantage of emitting a high pressure stream of liquid at the very outset of the dispensing step. For example, a soda dispenser sold by Jokari, 1205 Venture Court, Carrollton, Tex., has a configuration which allows fluid to be held under pressure just behind the dispensing nozzle when the apparatus is in the closed position. As a result of this design, it is possible for fluid to spray out of the nozzle in a small, fast stream when the nozzle is first opened. A device is needed which would prevent fluid from being retained under pressure just behind the discharge port, so as to not cause spraying at the start of the dispensing step.

Another drawback of the prior art is that many of the liquid dispensing devices contain valve actuating mechanisms which are not easy to use. For example, U.S. Pat. No. 4,194,653 discloses a device containing a valve mechanism which requires the user to press down on a cap which is mounted atop the apparatus. Such devices are difficult and uncomfortable to use. A device is needed which uses an actuating mechanism that is easy to use.

Yet another disadvantage of the devices presently known for use in dispensing liquids under pressure is that many such devices contain inadequate sealing mechanisms between the bottle and the device. For example, many do not have any sort of system to assure that the top of the bottle is lined up directly with the underside of the device to assure that the device is properly seated on the bottle. The result of such systems is that the top of the bottle neck may be bent slightly, thus possibly destroying the air-tight seal.

Another drawback in the prior art is that many of the dispensers use little more than a tube for transferring the liquid from the bottle to the dispenser. As a result, large quantities of carbon dioxide gas may escape from the liquid as it is dispensed, which causes the liquid to have a "flat" taste. An apparatus is needed which is capable of allowing increased retention of gaseous carbon dioxide in the liquid after it has been dispensed, as well as decreased foaming. Such a device would allow the fluid that has been dispensed to appear and taste better.

Yet another disadvantage of the prior art is that many devices which contain valve systems use configurations that cause the valve stem to move in a non-linear direction. In other words, as the valve is being actuated, the member which connects the valve to the handle moves slightly downward rather than in a straight line. Such members are often located within linear chambers. Such linear chambers typically include seals or other methods to prevent fluid from flowing into the member chamber. Because the member does not move in a linear direction, there is the increased possibility of wear and tear, and eventually leakage into the member chamber. Once fluid has leaked into the member chamber, it is possible for the fluid to leak out of the apparatus and onto the counter top, thus causing a mess. A device is needed which allows the member connecting the valve to the handle to move in a linear direction, such that the likelihood of leakage will be minimized.

The present invention provides a dispensing apparatus that overcomes the disadvantages of such prior known apparatus.

OBJECTS AND SUMMARY OF THE INVENTION

It is an object of the invention to provide a liquid dispensing apparatus that is simple in construction, inexpensive to manufacture, which is easily disassembled into several component parts by hand for easier cleaning, and which will minimize the loss of gaseous carbon dioxide from the liquid being dispensed. It is also an object of the invention to prevent spraying the fluid from the valve at the start of the dispensing process, and to prevent dripping of the fluid from the apparatus during the dispensing process as well as after dispensing is complete.

According to the present invention, there is provided a dispenser which includes a head element, a siphon tube, and a handle. Inside the head element is a chamber for fluid communication between an inlet port and a discharge port. The chamber contains a double plug seal mechanism for controlling fluid flow. The double seal plug generally includes a plug containing a forward end designed and shaped to form a watertight seal with the discharge port.

When the apparatus is in the closed position, the double seal plug is located fully forward, in a narrow portion of the plug chamber. The narrow portion of the plug chamber is sized and shaped to form a watertight connection with the aft end of the double seal plug. Thus both the forward end and the aft end of the double seal plug are designed to seal at different locations within the plug chamber, hence the name "double seal" plug. An actuator is connected to the double seal plug such that engaging the actuator causes the double seal plug to move aft, thus moving the double seal plug from the narrow portion of the plug chamber to a wider portion, and permitting fluid to flow through the head.

There are several benefits to the double seal plug/plug chamber configuration of the present invention. The primary benefit is that when the apparatus is returned to the closed position, all of the fluid in the plug chamber which is forward of the aft end of the double seal plug drains out of the apparatus. As a result, the narrow portion of the double seal plug chamber does not contain any fluid under pressure which might tend to spray out in a stream the next time the apparatus is used. Another benefit of the placement of the double seal plug fully forward in the seal plug chamber, and adjacent to the discharge port, is that there is no fluid forward of the plug when the apparatus is in the closed position. As such, the likelihood of drops of fluid clinging to the apparatus, and then dripping onto the counter top supporting the beverage container after the apparatus is used to dispense fluid, are eliminated or greatly reduced.

The present invention has particular utility for use in dispensing carbonated beverages such as soft drinks, beer, various carbonated mixes, etc., that are typically bottled in relatively large, (i.e., 24 to 32 fluid ounces) resealable bottles or containers. While the apparatus of the invention may be employed for dispensing any type of pressurized fluids, from any size or type container, the double seal plug aspect described herein can be used for controlling the flow of any type of fluid, whether pressurized or not.

The present invention also includes a siphon tube which dips below the surface of the fluid to be dispensed. The siphon tube of the preferred embodiment contains flow obstructing elements. The flow controllers are objects generally shaped and located to obstruct the flow of the fluid being dispensed. Such a configuration will result in the dispensed fluid retaining more carbon dioxide or other gases, as are present in fluids such as soft drinks, thus preventing the beverage from losing its taste or becoming "flat".

The present invention also has a novel configuration for connecting the double seal plug to the actuator which allows the connecting element to be operated in a linear direction only. The connecting element in the preferred embodiment is retained in a watertight shaft. The aft end of the connecting shaft contains a retaining device which fits within a slot located in the actuator. The shape and location of the slot allows the connecting element to move forward and aft in a linear direction, as opposed to moving in any sort of angular manner relative to its "resting" position. This linear movement eliminates the likelihood of the shaft rubbing against the chamber which seals it, thus reducing the wear and tear to the shaft and seal which comes from normal use. This configuration also reduces or eliminates liquid escaping through the chamber. Finally, the present invention includes a screw-type connector for connecting the apparatus to the fluid container. The connection is configured to assure that the head is aligned on the beverage container and therefore no fluid or gas will escape.

These and other objects and advantages of the present invention will become apparent from the following detailed description when viewed in conjunction with the accompanying drawings, which set forth certain embodiments of the invention.

BRIEF DESCRIPTION OF THE DRAWINGS

The following figures set forth the preferred embodiment of the present invention:

FIG. 2*a* illustrates an enlarged cutaway half-section showing portions of the head, connecting shaft, and actuator when the apparatus is in the "closed" position.

FIG. 2*b* illustrates a cutaway half-section of the apparatus in the "closed" position, where the apparatus is attached to a container having a threaded neck.

FIG. 3*a* illustrates an enlarged cutaway half-section showing portions of the head, connecting shaft, and actuator when the apparatus is in the "partially actuated" position.

FIG. 3*b* illustrates an enlarged cutaway half-section of the apparatus in the "partially actuated" position, where the apparatus is attached to a container having a threaded neck.

FIG. 4*a* illustrates an enlarged cutaway half-section showing portions of the head, connecting shaft, and actuator when the apparatus is in the "open" position.

FIG. 4*b* illustrates a cutaway half-section of the apparatus in the "open" position, where the apparatus is attached to a container having a threaded neck.

FIG. 5*a* is an enlarged cutaway half-section of the forward end of the plug chamber, with the apparatus in the "closed" position.

FIG. 5*b* illustrates a cutaway half-section of the apparatus in the "closed" position, where the apparatus is attached to a container having a threaded neck.

FIG. 6*a* is an enlarged cutaway half-section of the forward end of the plug chamber, with the apparatus in the "partially actuated" position.

FIG. 6*b* illustrates a cutaway half-section of apparatus in the "partially actuated" position, where the apparatus is attached to a container having a threaded neck.

FIG. 7*a* is an enlarged cutaway half-section of the forward end of the plug chamber, with the apparatus in the "open" position.

FIG. 7*b* illustrates a cutaway half-section of the apparatus in the "open" position, where the apparatus is attached to a container having a threaded neck.

FIG. 9*a* illustrates an enlarged cutaway half-section of the siphon tube in isolation with flow controllers present.

FIG. 9*b* is a cross-sectional view taken on line A—A of FIG. 9(*a*).

FIG. 10*a* illustrates the forward edge of the actuator, with hatched lines depicting internal chambers.

FIG. 10*b* illustrates a side view of the actuator, with hatched lines depicting internal chambers.

FIG. 10*c* illustrates a cross-sectional view of the actuator, taken on line A—A of FIG. 10(*b*).

Like reference characters indicate corresponding parts throughout the several views of the drawings.

DESCRIPTION OF THE PREFERRED EMBODIMENT

The present invention will now be described with reference to FIGS. 1 through 10. In this description, the term "forward" shall be used to indicate that portion of an element, or another item, that is located closer to the discharge port of the apparatus than the portion of the element or item being discussed. The term "aft" shall be used to refer to that portion of an element that is located further from the discharge port, and closer to the distal end of actuator 22, than the item under consideration. The terms "above" or "higher" shall be used to describe that an element that is at a higher vertical position than other elements when the sealing and dispensing mechanism is in the upright position, as would be the case when the apparatus is affixed to a fluid container. The words "below" or "lower" shall mean at a lower vertical position, or closer to the base of the fluid container.

Figure 1:
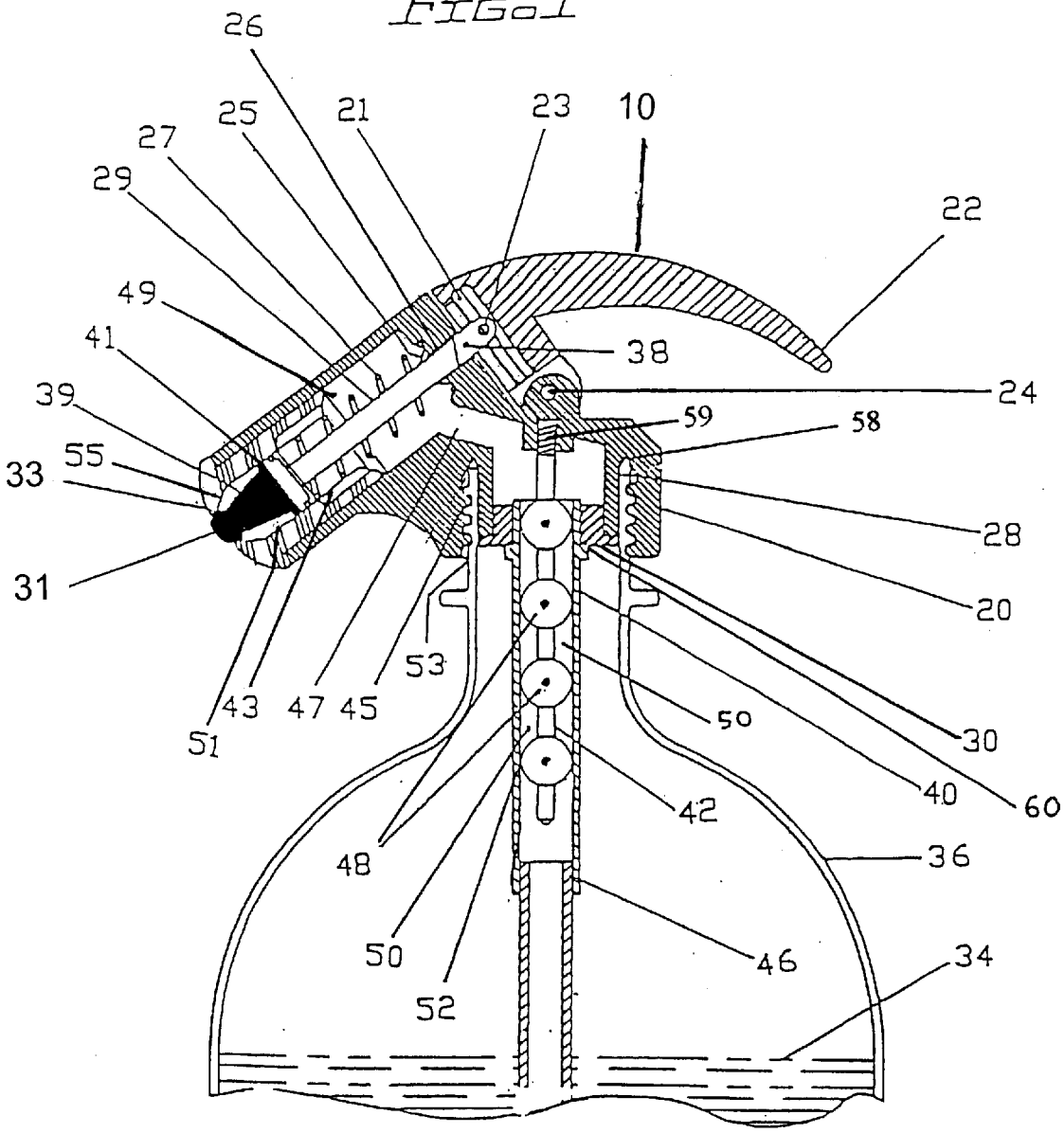
FIG. 1 illustrates a cutaway half-section of the entire dispenser apparatus attached to a container having a threaded neck.

FIG. 1 shows the entire dispensing and sealing apparatus 10. The apparatus 10 is installed on a typical fluid container 36 which contains a pressurized fluid 34. After the manufacturer's sealed cap (not shown) is removed from the fluid container 36, the sealing and dispensing apparatus 10 is attached in its place. With reference to FIG. 1, it can be seen that the apparatus includes, in a broad sense, a head 20 for attaching atop fluid container 36, a siphon tube 40, and an actuator 22. The head generally comprises an inlet port 60 for receiving fluid into the head, a discharge port 33 for discharging fluid from the head, and a fluid chamber 47 such that fluid may flow from the inlet port 60 to the discharge port 33. Fluid chamber 47 in the preferred embodiment has a vertical section adjacent to inlet port 60, and a plug chamber 49 that slopes downward at a forty-five degree angle and terminates in discharge port 33.

Within seal plug chamber 49 are narrow portion 51 and wider portion 43. In the preferred embodiment, discharge port 33 is adjacent to and in fluid connection with narrow portion 51. The forward end of plug chamber narrow portion 51 includes conical reducer portion 55. Seal plug chamber narrow portion 51 is adjacent to and in fluid connection with seal plug chamber wider portion 43. Seal plug chamber narrow portion 51 has a smaller cross section for fluid flow than wider portion 43. In the preferred embodiment, seal plug chamber wider portion 43 is fluted. By "fluted," it is to be understood that seal plug chamber wider portion 43 has both longitudinal supports about its inner perimeter which provide strength and grooves, or fluted portions, in between these longitudinal supports. The longitudinal supports are at approximately the same diameter axially as the inner wall of seal plug chamber narrow portion 51. The fluted portions, however, extend further axially from the center of plug chamber wider portion 43 than do the longitudinal supports. Thus, by virtue of the fluted portions, the overall cross-sectional area available for flow is greater in plug chamber wider portion 43 than in plug chamber narrow portion 51.

The fluid flow process through the head 20 of the preferred embodiment can be appreciated with reference to FIG. 1. Specifically, pressurized fluid 34 flows from the inlet port 60 through the fluid chamber 47, then into plug chamber wider portion 43, past double seal plug 39, then past plug chamber narrow portion 51, and finally out the discharge port 33 and into the drinking receptacle. In an alternative embodiment, double seal plug 39 is not located in the fully forward aspect of the apparatus; instead, there is additional fluid chamber forward of double seal plug 39.

Located centrally within plug chamber 49 is a double seal plug 39 which is uniquely designed to address the problems of the prior art discussed above. Double seal plug forward end 31 is sized and shaped to form a watertight seal with the discharge port 33, located at the forward end of the plug chamber narrow portion 51. Double seal plug aft end 41 has the same size and shape as plug chamber narrow portion 51, such that double seal plug aft end 41 forms a watertight seal with narrow portion 51 when the apparatus is in the closed position. Also in the preferred embodiment, seal plug 39 and seal plug chamber narrow portion 51 are approximately round. Any person skilled in the art will know that there are many other geometrical configurations which are available, as long as a watertight seal is formed between seal plug aft end 41 and plug chamber narrow portion 51.

With reference to FIGS. 5–7, the benefit of double seal plug 39 in the preferred embodiment can be demonstrated by the series of figures which depict the movement of the double seal plug 39 during the process of dispensing pressurized fluid 34. FIGS. 5*a* and 5*b* depict the present invention in its closed position, which is also its resting state, in which no beverage is flowing. As depicted in FIG. 5*b,* actuator 22 is in the fully forward position. As shown in FIG. 5*a,* connecting shaft 29 and double seal plug 39 are likewise fully forward. In fact, it should be noted that throughout the opening and closing processes, connecting shaft 29 is located primarily in the seal plug chamber. In the closed, the outer perimeter of double seal plug aft end 41 is flush against the inner wall of plug chamber narrow portion 51, thus forming a water-tight seal and preventing the flow of the pressurized fluid 34.

The user begins the process of dispensing fluid 34 by depressing the aft end of actuator 22. When the user depresses actuator 22 with sufficient force to overcome the resistance of compression spring 27, double seal plug 39 is pulled aft. FIG. 6*b* depicts the present invention with the actuator 22 partially depressed, prior to the start of beverage flow through the apparatus. Although double seal plug 39 is no longer fully forward in this configuration, it is still far enough forward to prevent fluid flow, as there remains a watertight seal between double seal plug aft end 41 and the inner wall of plug chamber wider portion 43.

As the user depresses actuator 22 further, the apparatus reaches the "open" position and fluid 34 begins to flow through the head. FIGS. 7*a* and 7*b* depict such a typical configuration of the apparatus in the open position. Specifically, actuator 22 is depressed far enough aft and down to cause double seal plug aft end 41 to withdraw into plug chamber wider portion 43. In this configuration, fluid 34 is able to flow between double seal plug aft end 41 and plug chamber wider portion 43, then finally out discharge port 33.

After sufficient fluid has been dispensed, the user releases actuator 22 and the series of events as depicted in FIGS. 5–7 is reversed. However, additional features of the present invention are more fully understood by considering this closing process.

As described above, FIGS. 7*a* and 7*b* depict the apparatus in the open position, wherein fluid would flow between the double seal plug aft end 41 and plug chamber wider portion 43. As actuator 22 is partially released, double seal plug aft end 41 moves forward and again forms a watertight seal with plug chamber narrow portion 51, thus preventing the flow of fluid. This configuration is depicted in FIGS. 6*a* and 6*b*. As this occurs, all fluid forward of the double seal plug aft end 41 is able to drain out discharge port 33. Thus, there is no beverage trapped forward of double seal plug aft end 41 when the apparatus is in the closed position, as depicted in FIGS. 5*a* and 5*b*.

Moreover, the seal plug configuration of the preferred embodiment contains an additional advantage in that double seal plug forward end 31 is located at the forward end of fluid chamber 47 when the actuator 22 is completely released. Stated another way, there is no discharge conduit forward of double seal plug forward end 31 when the apparatus is in the closed position. As a result, it is significantly less likely that there will be any drips of fluid adhering to the forward end of the apparatus after the dispensing step.

Finally, another advantage of the seal plug configuration of the present invention concerns the likelihood that fluid under pressure will forcibly spray out of the discharge port at the very beginning of the discharge step. Specifically, as the apparatus returns to the closed position all fluid forward of the double seal plug aft end 41 is able to drain out discharge port 33. This configuration prevents fluid from "spraying" out discharge port 33 at the start of the dispensing step. In other words, because there is no fluid under pressure in the narrow portion 51 of plug chamber 49 when the apparatus is in the closed position, there will be no stream of fluid 34 forced between the double seal plug forward end 31 when actuator 22 is only slightly depressed. These innovations both reduce the possibility of fluid dripping from nozzle discharge port 33 onto the countertop or refrigerator shelf subsequent to the dispensing process. Furthermore, these innovations and the lack of fluid entrapment pockets exposed to the atmosphere reduces the possibility that fluid will be left to stagnate in the plug chamber 49 after dispensing is complete.

Other advantages of the present invention concern the configuration of actuator 22. These aspects can best be understood with references to FIGS. 2–5, and 10. Actuator 22 contains a pivot assembly, which includes a retaining device such as pivot pin 24. As a result of the pivot assembly, when combined with other aspects of the present invention, the user is able to operate the dispensing apparatus 10 between the closed position and the open position by depressing the aft end of actuator 22, even though connecting shaft 29 is retained within a linear connecting shaft chamber. In other words, the design of actuator 22 allows for connecting shaft 29 to travel linearly at all positions between the fully open position and the fully closed positions even though actuator 22 pivots.

The ability of connecting shaft 29 to move linearly at all times can be attributed in part to the presence of a slot, such as driver pin slot 21 in actuator 22 . Driver pin 23 is attached to the aft end of connecting shaft 29 such that driver pin 23 has a horizontal orientation that is also perpendicular to connecting shaft 29. Driver pin slot 21 is oriented so as to allow driver pin 23 to travel along the length of driver pin slot 21 as the actuator is pivoted between the open and closed positions. This can be better appreciated with reference to FIGS. 2–4 and 10, and a discussion of the invention in various states of opening.

First, FIGS. 2*a* and 2*b* depict dispensing apparatus 10 in the "closed" position. In this configuration, connecting shaft 29 is fully forward, as is actuator 22. FIGS. 3*a* and 3*b* depict dispensing apparatus 10 in a partially actuated position, or a position which is closer to being "open" than the position depicted in FIGS. 2*a* and 2*b*. In this configuration, actuator 22 is slightly pivoted about a pivot pin 24. Connecting shaft 29 has been pulled aft slightly, and driver pin 23 has traveled from its "closed" location to a lower position within driver pin slot 21. FIGS. 4*a* and 4*b* next depict actuator 22 fully opened, with connecting shaft 29 in its fully aft position. Driver pin 23 has now traveled to an even lower position within driver pin slot 21 than in FIGS. 2*a* and 2*b*. It should be noted that even though actuator 22 has pivoted, connecting shaft 29 has traveled in a straight line at all times.

In the preferred embodiment, actuator 22 contains connecting shaft slot 71. These aspects of actuator 22 can be better understood with reference to FIGS. 10*a* and 10*c*. Connecting shaft slot 71 allows the aft end of connecting shaft 29 to pass through the forward edge of actuator 22. Also, the aft end of connecting shaft 29 has flat portion 38 by which the aft end of connecting shaft 29 fits through connecting shaft slot 71. Just aft of driver pin slot 21 is a narrower slot, driver pin recess slot 81, which allows the aft end of connecting shaft 29 to avoid rubbing against actuator 22 as it travels along driver pin slot 21.

Although FIGS. 10*a* and 10*c* depict actuator 22 of the preferred embodiment in its isolated configuration, it is to be understood that in its normal configuration, actuator 22 is connected to head 20 as previously described. FIGS. 10*a* and 10*c* show the top view of actuator 22 as cut along Line A—A to more clearly denote the relative positions of connecting shaft slot 71, driver pin slot 21, and driver pin recess slot 81.

Yet another aspect of the present invention can be see with reference to FIG. 1. As discussed above, double seal plug 39 is connected to actuator 22 by connecting shaft 29. Connecting shaft 29 passes through connecting shaft chamber 26. At the forward end of connecting shaft chamber 26 is located connecting shaft seal 25, which is a water-tight seal designed to prevent the flow of fluid into connecting shaft chamber 26. It should be noted that connecting shaft seal 25 is not a separate, individual piece, but rather a constriction of the material used to form head 20 at the forward end of connecting shaft chamber 26.

The present invention also relates to a pressure-reducing mechanism in conjunction with dispensing a fluid. More specifically, the present invention relates to a siphon tube which contains one or more flow controllers which serve to gradually reduce the pressure of the beverage being dispensed by obstructing the flow of the beverage. These obstructors also serve to reduce the amount of foaming that occurs during the dispensing process. This aspect of the present invention can be better appreciated by reference to FIGS. 1 and 9.

According to the present invention, siphon tube 40 extends from head 20 into fluid 34. Inside siphon tube 40 are located one or more flow controllers 48. The flow controllers 48 force the fluid to flow through a narrow channel between the perimeter of flow controller 48 and the inner wall of siphon tube 40. After the fluid passes each flow controller 48, the fluid then enters a relatively unobstructed segment of siphon tube 40, denoted on FIG. 1 by the number 50. As the fluid passes the next flow controller, the process repeats itself, resulting in yet another small reduction in pressure. The final effect of this aspect of the present invention is to minimize the overall loss of gases such as carbon dioxide in the fluid, as well as any foaming, if any, thus resulting in improved taste and feel of the beverage to the user as compared to one large drop in pressure. It should be noted, however, that not all beverages would require the use of a series of flow controllers, such as, for example, seltzer, and therefor an alternative embodiment of the present invention would have no flow controllers.

It has been determined that, although at least one obstructor is needed if the pressure step-down process of using flow controllers is to be used, any number of flow controllers may be used limited only by the number of obstructors that may fit vertically within the siphon tube. It is to be understood that flow controllers 48 may be any shape which is conducive to gradually reducing the pressure of the fluid as it is dispensed. For example, the flow controllers may be approximately spherical, as is the case in the preferred embodiment. Other shapes may work also, but best results are achieved with flow controllers that do not contain sharp comers, but instead have smooth surfaces.

It has also been determined that the distance between flow controllers may vary, yet still result in an effective siphon. For instance, the siphon tube may be packed with flow controllers from top to bottom, such that the top of one flow controller is touching the bottom of the one above it. Alternatively, the obstructors may be arranged in the siphon tube such that there is a gap between them.

A third approach, as used in the preferred embodiment, would be to affix the flow controllers to a shaft, such that there is a gap between each of the obstructors, and then to insert the shaft into the siphon tube. An additional advantage to this last configuration is that the shaft and the flow controllers may be removed from the siphon tube for cleaning. The cross section of the flow controllers should be sufficient to cause a pressure drop of noticeable magnitude. In the preferred embodiment, for example, the axial cross-section of each flow controller 48 is between approximately 90% and approximately 95% of the axial cross-section of siphon tube 40. In other words, between 90% and 95% of the cross-sectional area available for flow in siphon tube 40 is blocked the widest part of a flow controller. In alternative embodiments, however, the ratio of flow controller cross section to siphon tube cross section may be significantly lower, for example, as low as 80%.

According to the present invention, at least one flow controller nub 52 is located on the perimeter of at least one flow controller 48. Each flow controller nub 52, being located on the horizontal perimeter of flow controller 48, ensures that a gap is maintained for fluid flow between the outer perimeter of flow controller 48 and the inside wall of siphon tube 40. Flow controller nubs 52 may be of any size and shape which will accomplish the purpose of ensuring separation between flow controllers 48 and the inside wall of siphon tube 40. In the preferred embodiment, three flow controller nubs 52 are located on the perimeter of each flow controller 48, with each flow controller nub being located approximately 120 degrees apart.

These aspects of the preferred embodiment can be seen with reference to FIG. 1. In the preferred embodiment, flow controller shaft 42 is located inside siphon tube 40. Flow controller shaft 42 has multiple flow controllers 48 attached along its longitudinal axis. At the upper end of flow controller shaft 42 is flow controller shaft thread end 59. Flow controller shaft thread end 59 screws into head 20, thus allowing for removal of flow controller shaft 42 from siphon tube 40 for cleaning. The preferred embodiment also includes a siphon tube extension 46 which attaches to the lower end of siphon tube 40, thus permitting the flow controller aspects of the present invention to be maintained entirely withing siphon tube 40. In an alternative embodiment, there is no siphon tube extension 46; rather, siphon tube 40 extends to below the level of the fluid 34.

The preferred embodiment of the present invention utilizes friction fits to hold the inlet end of siphon tube 40 inside the longitudinal center hole of reducer connecting bushing 30, and also to hold reducer connecting bushing 30 inside inlet port 60. Such a configuration also aids in easy disassembly. It is to be understood, however, that other methods of engaging siphon tube 40 and reducer connecting bushing 30 are well known in the art, and would fall within the spirit and scope of the present invention.

The present invention also relates to an improved method for attaching dispensers to beverage containers. More specifically, head 20 of the present invention includes portions defining an annular opening for receiving the threaded top of a beverage container. The top of this annular opening is shaped so as to encourage an exact alignment between the head 20 and the neck of fluid container 36.

Figure 8:
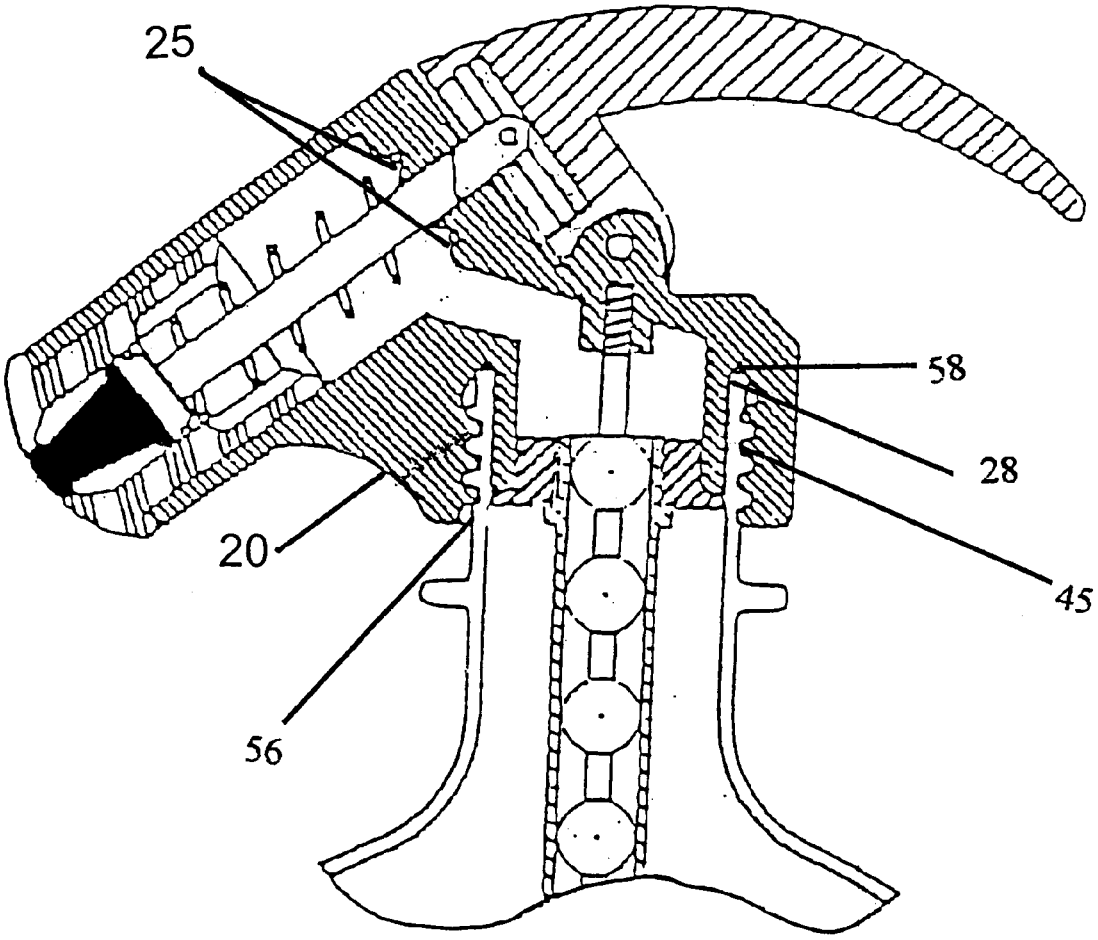
FIG. 8 is an enlarged cutaway half-section of the actuator and the lower portion of the head, depicting the annular opening by which the head attaches to a fluid container, with no container present.

Referring to FIG. 8, head 20 contains annular opening 56 which includes an inner perimeter 28, and an outer perimeter containing female threads 45 for removably engaging the fluid container (not shown) to dispensing head 20. Annular opening outer perimeter and inner perimeter meet at an angle less than ninety degrees to form annular groove 58. In the preferred embodiment, annular groove 58 is "v"-shaped such that the top of the neck of fluid container (shown in FIG. 1 as 36) is forced into vertical alignment with annular opening inner perimeter 28 as dispensing apparatus 10 is fully engaged. The most commonly used size for a carbonated beverage container is a 28 mm threaded neck, although the invention should not be limited to this size. The device can be modified to be of any desired size. It should be noted that neither fluid container 36 nor its external male threads 53 (shown in FIG. 1) are part of the claimed invention.

The dispensing apparatus 10 is connected to fluid container 36 by rotating dispensing apparatus 10 so as to engage both sets of threads. Rotation continues until an airtight seal is achieved between beverage container 36 and head 20.

To dispense fluid from the preferred embodiment, the user simply screws the dispensing apparatus 10 onto the external male threads 53 of fluid container 36. The user then gently agitates the contents of the container 36 by shaking lightly. Next, the user depresses actuator 22 with sufficient force to overcome the resisting force of compression spring 27, and fluid will flow through the apparatus into a glass or other receptacle.

It should be noted that the various elements of the present invention may be used to achieve the purposes described herein alone or in combination. For example, the double seal plug configuration may be used in any fluid control device, with or without other elements of the present invention.

What is claimed is:

1. An apparatus for dispensing a pressurized fluid from a container, said apparatus comprising:

(a) a head;

(b) said head connectable to the container;

(c) said head comprising an inlet port, a discharge port, and portions defining a fluid chamber for fluid communication between said inlet port and said discharge port;

(d) a seal plug;

(e) said seal plug being positioned inside said fluid chamber;

(f) said seal plug being actuable for movement between an open position allowing fluid flow through said discharge port and a closed position blocking fluid flow;

(g) said seal plug having a forward end and an aft end;

(h) said seal plug forward end being sized and shaped such that said forward end forms a watertight seal with said discharge port when said apparatus is in the closed position;

(i) a connecting shaft;

(j) said connecting shaft having a first end and a second end;

(k) said connecting shaft first end being connected to said seal plug;

(l) a driver pin;

(m) said driver pin being connected to said connecting shaft second end;

(n) an actuator;

(o) said actuator comprising a handle, a pivot point and portions defining a slot;

(p) said pivot point being located so as to allow said actuator to pivot as said apparatus is operated between the open position and the closed position by the user actuating said handle;

(q) said slot holding said driver pin;

(r) said slot being oriented so as to allow said driver pin to travel along the length of said slot as said actuator is pivoted;

(s) said slot being further oriented such that as said driver pin travels along the length of said slot, said connecting shaft is able to travel in a linear direction;

(t) a siphon tube;

(u) said siphon tube comprising a head end and an inlet end; and (v) said head end being connected to said inlet port and said inlet end projecting below the surface of the fluid in the container.

2. The apparatus of claim 1, wherein:

(a) said fluid chamber further comprises portions defining a plug chamber;

(b) said plug chamber comprises a narrow portion and a wider portion;

(c) said plug chamber narrow portion having a smaller cross-section for fluid flow than said plug chamber wider portion;

(d) said plug chamber narrow portion being adjacent to said plug chamber wider portion;

(e) said seal plug aft end being sized and shaped to form a watertight connection with said narrow portion; and (f) said seal plug being dimensioned such that said seal plug aft end is located in said plug chamber narrow portion when said apparatus is in the closed position and said seal plug aft end is located in said seal plug chamber wider portion when said apparatus is in said open position.

3. The apparatus of claim 2, wherein:

(a) said plug chamber narrow portion is non-fluted; and (b) said plug chamber wider portion is fluted.

4. The apparatus of claim 2, wherein said plug chamber narrow portion has an approximately round cross section.

5. The apparatus of claim 2, wherein said head is removably connectable to the container.

6. The apparatus of claim 5, wherein (a) said head further comprises portions defining an annular opening for receiving the threaded top of the container;

(b) said annular opening comprising an outer perimeter and an inner perimeter;

(c) said outer perimeter comprising a threaded connection for mating to the container; and (d) said outer perimeter meeting said inner perimeter at an angle less than ninety degrees to form an annular groove.

7. The apparatus of claim 6 wherein said annular groove is tapered such that when the container is attached to said head, the container is forced into vertical alignment with said annular chamber inner perimeter.

8. The apparatus of claim 6 wherein said annular groove is "v"-shaped such that when the container is attached to said head, the container is forced into vertical alignment with said inner perimeter.

9. The apparatus of claim 2 further comprising:

(a) one or more flow controllers;

(b) said one or more flow controllers being located within said siphon tube; and (c) said one or more flow controllers being shaped and placed within said siphon tube such that the flow of the beverage through said siphon tube is partially obstructed when the pressurized fluid encounters said one or more obstructors.

10. The apparatus of claim 9, further comprising:

(a) a flow controller shaft;

(b) said flow controller shaft being located within said siphon tube; and (c) said one or more flow controllers being affixed to said shaft.

11. The apparatus of claim 10, wherein the axial cross-section of each of said one or more flow controllers is between approximately 90% and approximately 95% of the axial cross-section of said siphon tube.

12. The apparatus of claim 9, wherein said one or more flow controllers are substantially spherical.

13. The apparatus of claim 9, further comprising:

(a) one or more nubs;

(b) said one or more nubs being located on at least one of said one or more flow controllers; and (c) said one or more nubs being located on the perimeter of said one or more flow controllers for ensuring that a gap is maintained for fluid flow between said outer perimeter of said one or more flow controllers and said inside wall of said siphon tube.

14. The apparatus of claim 2, wherein said siphon tube is removably connected to said head.

15. An apparatus for dispensing a pressurized fluid from a container, said apparatus comprising:

(a) a head;

(b) said head comprising an inlet port, a discharge port, and portions defining a fluid chamber for fluid communication between said inlet port and said discharge port;

(c) said head being removably connectable to the container;

(d) said fluid chamber further comprising portions defining a vertical component and portions comprising a plug chamber;

(e) said plug chamber sloping downward at an angle of about forty-five degrees with respect to the vertical axis;

(f) said plug chamber comprising a narrow portion and a wider portion;

(g) said plug chamber narrow portion having a smaller cross-section for fluid flow than said plug chamber wider portion;

(h) said plug chamber narrow portion being adjacent to and terminating in said discharge port;

(i) said plug chamber narrow portion having an approximately round cross section;

(j) said plug chamber narrow portion being non-fluted;

(k) said plug chamber narrow portion being adjacent to said plug chamber wider portion;

(l) said plug chamber wider portion being fluted.

(m) a seal plug;

(n) said seal plug being positioned inside said fluid chamber;

(o) said seal plug being actuable for movement between an open position allowing fluid flow through said discharge port and a closed position blocking fluid flow;

(p) said seal plug having a forward end and an aft end;

(q) said seal plug forward end being sized and shaped such that said forward end forms a watertight seal with said discharge port when said apparatus is in the closed position;

(r) said seal plug aft end being sized and shaped to form a watertight connection with said seal plug chamber narrow portion;

(s) said seal plug being dimensioned such that said seal plug aft end is located in said plug chamber narrow portion when said apparatus is in the closed position and said seal plug aft end is located in said seal plug chamber wider portion when said apparatus is in the open position;

(t) an actuator;

(u) said actuator comprising a handle, a pivot point and portions defining a slot;

(v) said pivot point being located so to allow said actuator to pivot as said apparatus is operated between the open position and the closed position by the user actuating said handle;

(w) a driver pin;

(x) said slot holding said driver pin;

(y) a connecting shaft;

(z) a connecting shaft chamber;

(aa) a connecting shaft seal;

(bb) said connecting shaft seal being located at said connecting shaft chamber forward end;

(cc) said connecting shaft seal being formed of the same material as said head and designed to prevent the flow of fluid into said connecting shaft chamber;

(dd) said connecting shaft passing through said connecting shaft chamber;

(ee) a compression spring;

(ff) said connecting shaft being located primarily in said seal plug chamber when said actuator is in the closed position due to the force of said compression spring;

(gg) said connecting shaft having a first end and a second end;

(hh) said connecting shaft first end being connected to said seal plug;

(ii) said connecting shaft second end being connected to said driver pin;

(jj) said slot being oriented so as to allow said driver pin to travel along the length of said slot as said actuator is pivoted;

(kk) said slot being further oriented such that as said driver pin travels along the length of said slot, said connecting shaft is able to travel in a linear direction;

(ll) a siphon tube;

(mm) a siphon tube extension;

(nn) said siphon tube comprising a head end and an inlet end;

(oo) said siphon tube head end being removably connected to said head;

(pp) said siphon tube inlet end being connected to said siphon tube extension;

(qq) said siphon tube extension projecting below the surface of the fluid in the container;

(rr) one or more flow controllers;

(ss) said one or more flow controllers being shaped and placed within said siphon tube such that the flow of the fluid through said siphon tube is partially obstructed when the pressurized fluid encounters said one or more controllers;

(tt) said one or more flow controllers being substantially spherical;

(uu) each of said one or more flow controllers having an axial cross section that is between approximately 90% and approximately 95% of the axial cross-section of said siphon tube;

(vv) each of said one or more flow controllers having three or more nubs;

(ww) said three or nubs being located on the horizontal perimeter of said one or more flow controllers for ensuring that a gap is maintained concentrically about the perimeter of said one or more flow controllers such as to allow fluid flow between said outer perimeter of said one or more flow controllers and the inside wall of said siphon tube;

(xx) a flow controller shaft;

(yy) said flow controller shaft being located within said siphon tube;

(zz) said one or more flow controllers being affixed to said flow controller shaft;

(aaa) said flow controller shaft being threadably attached to said head;

(bbb) said head further comprising portions defining an annular opening for receiving the threaded top of the container;

(ccc) said annular opening comprising an outer perimeter and an inner perimeter;

(ddd) said outer perimeter comprising a threaded connection for mating to the container;

(eee) said outer perimeter meeting said inner perimeter to form an annular groove; and (fff) said annular groove being "v"-shaped such that when the container is attached to said head, the container is forced into vertical alignment with said inner perimeter.

* * * * *